US005205415A

United States Patent [19]

Surtees

[11] Patent Number: 5,205,415

[45] Date of Patent: Apr. 27, 1993

[54] MODULAR CLASSIFIER

[75] Inventor: Guy F. Surtees, Wilson, N.C.

[73] Assignee: The Standard Commercial Tobacco Co., Inc., Wilson, N.C.

[21] Appl. No.: 727,974

[22] Filed: Jul. 10, 1991

[51] Int. Cl.[5] ..... B07B 9/00

[52] U.S. Cl. ..... 209/21; 131/312; 209/44.1; 209/139.1; 209/631; 209/639; 209/642

[58] Field of Search ..... 209/12, 21, 44.1, 132, 209/133, 134, 135, 136, 137, 138, 139.1, 147, 153, 629, 631, 638, 639, 641, 642; 131/312

[56] References Cited

U.S. PATENT DOCUMENTS

| | | | |
|---|---|---|---|
| 518,082 | 4/1894 | Stuckey et al. | 209/642 |
| 974,395 | 11/1910 | Kidder | 209/44.2 |
| 1,530,277 | 3/1925 | Mettler, Sr. | 209/137 |
| 1,863,666 | 6/1932 | Lorentz | 209/133 |
| 1,903,931 | 4/1933 | Molins et al. | 131/110 |
| 1,962,668 | 6/1934 | Olney | 209/136 |
| 2,130,880 | 9/1938 | Durning | 131/57 |
| 2,173,088 | 9/1939 | Eissmann | 209/139 |
| 2,275,849 | 3/1942 | Fraser | 209/466 |
| 2,658,617 | 11/1953 | Rowell | 209/137 |
| 2,667,174 | 1/1954 | Eissmann | 131/146 |
| 2,825,457 | 3/1958 | Rowell | 209/139 |
| 2,852,137 | 9/1958 | Hagopian | 209/139 |
| 2,941,667 | 6/1960 | Hilgartner, Jr. et al. | 209/134 |
| 2,944,629 | 7/1960 | Eissmann | 183/34 |
| 2,988,213 | 6/1961 | Davis et al. | 209/21 |
| 3,010,576 | 11/1961 | Harte et al. | 209/35 |
| 3,034,646 | 5/1962 | Eissmann et al. | 209/133 |
| 3,074,413 | 1/1963 | McArthur | 131/84 |
| 3,092,117 | 6/1963 | Labbe | 131/110 |
| 3,164,548 | 1/1965 | Rowell et al. | 209/139 |
| 3,200,947 | 8/1965 | Wochnowski | 209/133 |
| 3,240,335 | 3/1966 | Vandenhoeck | 209/136 |
| 3,265,209 | 8/1966 | Wochnowski et al. | 209/136 |
| 3,308,950 | 3/1967 | Harte et al. | 209/137 |
| 3,360,125 | 12/1967 | Horsey | 209/12 |
| 3,362,414 | 1/1968 | Wochnowski | 131/146 |
| 3,378,140 | 4/1968 | Wochnowski et al. | 209/137 |
| 3,397,782 | 8/1968 | Kwong et al. | 209/177 |
| 3,443,688 | 5/1969 | Molins | 209/12 |

(List continued on next page.)

FOREIGN PATENT DOCUMENTS

| | | | |
|---|---|---|---|
| 0483698 | 11/1974 | Australia | 209/139.1 |
| 0630756 | 6/1936 | Fed. Rep. of Germany | 209/137 |
| 0828904 | 6/1938 | France | 209/137 |
| 1473911 | 3/1967 | France | 131/312 |
| 0047566 | 1/1940 | Netherlands | 209/137 |
| 0685417 | 1/1953 | United Kingdom | 131/312 |
| 746106 | 3/1956 | United Kingdom . | |
| 0755252 | 8/1956 | United Kingdom . | |
| 1167866 | 10/1969 | United Kingdom . | |
| 2231770 | 11/1990 | United Kingdom | 131/312 |

OTHER PUBLICATIONS

Prosecution History 07/304267.

Prosecution History 088390.

"Jobson FB Separator Designed to Shorten Tobacco Threshing Line", Dec. 23, 1988 (no author listed).

"New Threshing Line Offers Cost, Noise and Space Benefits" by The Cardwell Machine Company.

"Single Pass Classifier Reduces Leaf Degradation" from Tobacco reporter, Apr., 1985.

*Primary Examiner*—Andres Kashnikow

*Assistant Examiner*—Joseph A. Kaufman

*Attorney, Agent, or Firm*—Wood, Herron & Evans

[57] ABSTRACT

Apparatus for classifying tobacco includes a plurality of vertical lift, single-pass, closed loop apparatus projecting a stream of mixed tobacco components across a classifying chamber of each module, and a portion thereof directly into the infeed apparatus of the next downstream module. A common porous conveyor extending through the modules of the closed loop air stream removes tobacco heavies. A second lower reversible conveyor removes overflow and dust or other particles falling out of suspension and deposits same in the heavier discharge or in another collection point. The modules as well as the infeed apparatus are interchangeable.

34 Claims, 5 Drawing Sheets

U.S. PATENT DOCUMENTS

| | | | |
|---|---|---|---|
| 3,542,037 | 11/1970 | Pietralunga | 131/109 |
| 3,593,851 | 7/1971 | Davidson | 209/133 |
| 3,608,716 | 9/1971 | Rowell et al. | 209/139 R |
| 3,655,043 | 4/1972 | Wochnowski et al. | 209/138 |
| 3,727,755 | 4/1973 | Cristiani | 209/45 |
| 3,986,949 | 10/1976 | Di duca et al. | 209/35 |
| 4,003,385 | 1/1977 | Adebahr et al. | 131/84 B |
| 4,045,334 | 8/1977 | Ferrary et al. | 209/141 |
| 4,213,852 | 7/1980 | Etkin | 209/136 |
| 4,253,940 | 3/1981 | Price | 209/3 |
| 4,405,451 | 9/1983 | Roman | 209/136 |
| 4,411,038 | 10/1983 | Mukai | 15/3.13 |
| 4,465,194 | 8/1984 | Coleman | 209/639 |
| 4,475,562 | 10/1984 | Thatcher et al. | 131/110 |
| 4,618,415 | 10/1986 | Vecchio et al. | 209/134 |
| 4,701,256 | 10/1987 | Cross | 209/139.1 |
| 4,755,284 | 7/1988 | Brooks et al. | 209/20 |
| 4,915,824 | 4/1990 | Surtees | 209/139.1 |
| 5,099,863 | 3/1992 | Coleman | 131/312 |

MODULAR CLASSIFIER

This invention relates to classifiers and more particularly to the separation of lighter tobacco fractions from heavier tobacco fractions in a mix of threshed tobacco.

BACKGROUND OF THE INVENTION

In the processing of tobacco, threshers are used to remove tobacco leaf or lamina from the stem portions of the plant. The mixed stem and leaf fractions are discharged from the thresher in a mixed stream of tobacco material. This stream is then typically conveyed to a classifier or separator where the lighter fractions such as lamina, are separated from the heavier fractions, such as stem or stem with leaf attached. One such separator is disclosed, for example, in U.S. Pat. No. 4,915,824.

To improve the integrity of the separated components, it has been proposed to link several classifiers together, with each discharging the heavy components directly into another classifier. Another proposal has been to project a mixed tobacco stream across a large chamber having a plurality of "lights" discharge openings fed by means of an inclined upward air flow. While these suggestions have been referred to as being "modular," they do not present modular apparatus in the true sense of the word since the respective separators and other components are not interchangeable.

Moreover, it has been observed that most tobacco classifiers must be cleaned out daily, consuming time and detracting from operation efficiency.

Accordingly, it has been one objective of this invention to provide a modular classifying apparatus wherein the modules and other components are interchangeable.

A further objective of the invention has been to provide self-cleaning modular classifier apparatus.

A further objective of the invention has been to provide a classifying module and infeed apparatus which can be combined or interchanged with other modules and infeeds for classifying light fractions from heavier fractions in a mix thereof introduced to each module.

SUMMARY OF THE PRESENT INVENTION

To these ends, a preferred embodiment of the invention contemplates a plurality of operationally linked single pass, vertical lift modules, each fed by an infeed means discharging certain of the heavier fractions across the module directly into the infeed means of the next downstream module. The infeed means of each module projects mixed tobacco fed to it across a classifying chamber defined in each module, where lighter fractions are lifted and separated from heavier fractions by means of a vertically upward moving portion of a closed air loop.

Each module has a heavy fraction removal chamber adapted for interconnection to like chambers of adjacent modules on either side of the module. A common porous conveyor apron extends through such interconnected chambers to convey heavies to a single discharge point.

Each module has an air inlet plenum beneath the porous apron for receiving air from a blower and directing it upwardly through the apron for separating light fractions from heavier fractions cast across the classifying chamber. A reversible common second conveyor extends beneath each module in the air inlet plenums for catching and conveying dust or other material falling from the porous apron and out of the air stream. When operated in one direction, the second conveyor discharges material thereon back into the heavies emanating from the linked modules. When operating in another direction, the second conveyor discharges material thereon to a different discharge point for removal, processing or disposal.

The infeed apparatus for each module receives incoming tobacco material directly from the initial feed duct or from the next upstream module, and projects a stream of material across its own classifying chamber directly toward the inlet of the next module's infeed apparatus. The infeeds may be of a variety of types, such as belt, rotor or winnower and each infeed, regardless of type, is preferably constructed so it is interchangeable with any other infeed.

Each module in the chain thus has three different effluents, lights, mixed tobacco projected into the infeed of the next downstream module, and heavies, such as stems with no attached lamina.

Any number of modules can be linked together depending on the classification results desired, and it is not necessary to provide separate conveying apparatus to convey the mixed effluent from one module to the next. Should any infeed apparatus break down, or should another type infeed be desired, it is only necessary to unbolt the infeed in place and insert the desired unit.

Accordingly, the invention provides a truly modular, self-cleaning classifier having the capacity to save large amounts of energy required by systems where separate conveying apparatus is required between each separator. There is a smooth flow of tobacco through the linked modules with no "heavies" surging as is found in some vertical lift classifiers. Maintenance down time is reduced, and various infeed devices can be selected as they are interchangeable. Upgrading and reconfiguring of threshing lines is rendered less expensive and more easily accomplished.

These and other objectives and advantages will become readily apparent from the following detailed description of a preferred embodiment of the invention and from the drawings in which.

DETAILED DESCRIPTION OF A PREFERRED EMBODIMENT

Figure 1:
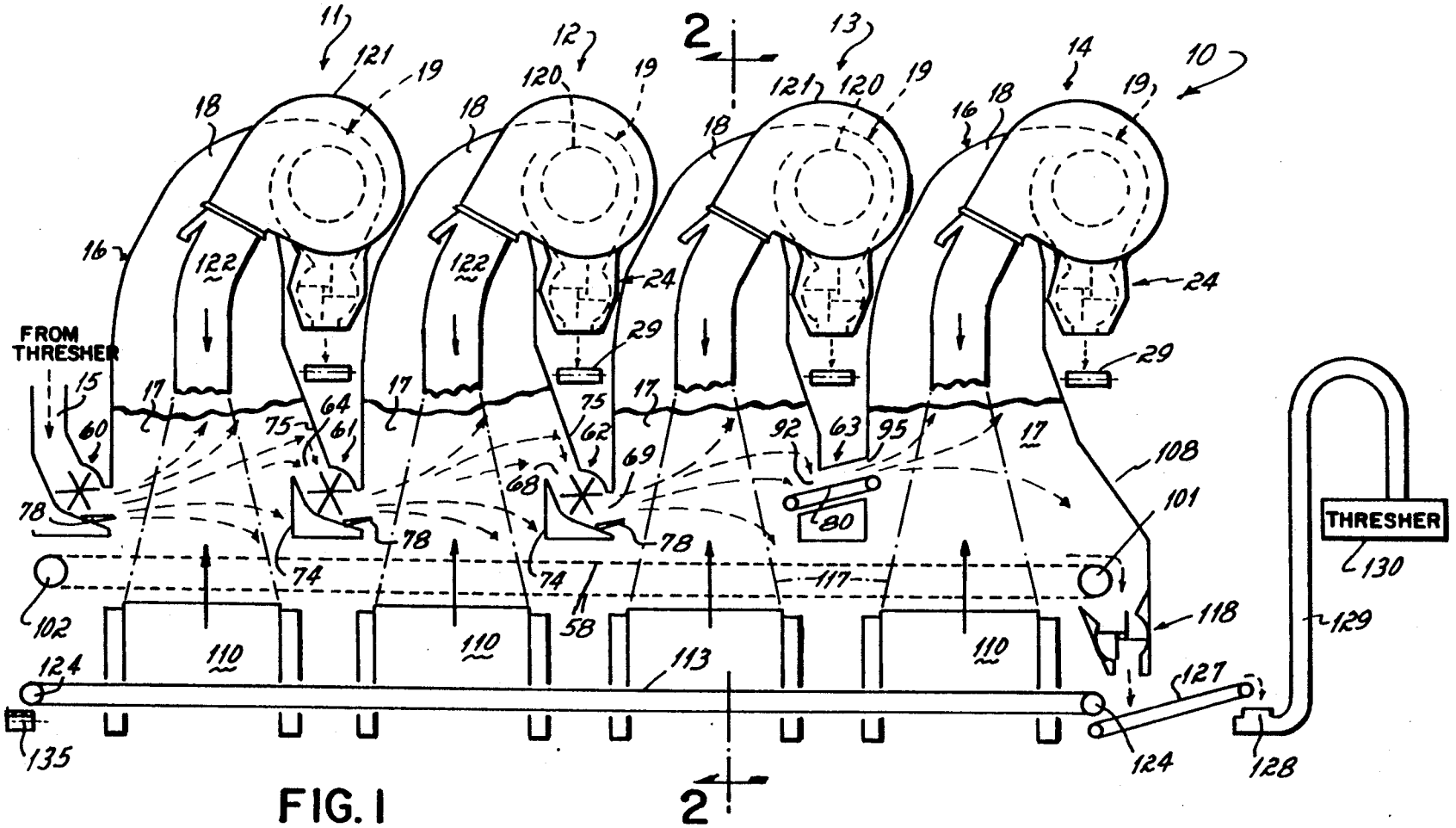
FIG. 1 is a very diagrammatic elevational view of a modular classifier according to the invention.

Turning now to FIG. 1 there is shown therein a modular classifier apparatus 10. While there may be other applications for such apparatus one particular application which the invention depicted in FIG. 1 has found particularly utility is in the classification of tobacco.

More particularly, it is common to thresh tobacco leaves to separate the leaf or lamina portion of leaf from the stem portion. Upon discharge from the threshing machine, the tobacco constitutes a plurality of different forms. It includes free lamina, lamina attached to stem, and clean stem. The free lamina are generally considered to be a light fraction of the mixture emanating from the thresher, while the stems are generally considered to be a heavy fraction. The lamina attached to the stems are also heavies or intermediates.

After this mixed threshed tobacco is discharged from the thresher, it is desirable to separate the clean or light lamina from the stem containing parts of the mixed tobacco. In the past, single-pass, vertical lift separators and many other types of separators have been utilized for this function. One form of such a single pass vertical lift separator is shown in U.S. Pat. No. 4,915,824. From such a classifier, the tobacco may be discharged for processing, for further threshing or the like.

In some instances, it is desirable to further classify the tobacco mixture not lifted off at such a first separator. Accordingly, effluent from the first separator is typically conveyed to a second separator, and so on until the proper separation points are reached. Such a configuration of separation apparatus is expensive and space consuming. Moreover, the conveying apparatus running between each of the separators requires a great deal of energy.

In a preferred embodiment of the invention, such as shown in FIG. the modular classifying apparatus includes a plurality of vertical lift, single pass separators 11, 12, 13, 14. Each separator is similar in construction, except as noted below. Each is connected to another for receiving a mixture of tobacco, casting it across a classification chamber, collecting lights lifted away from the projected tobacco stream, and collecting heavies and other components for further treatment or separation.

From FIG. 1 then it will be appreciated that tobacco from an upstream thresher or other equipment is introduced through an inlet chute 15 into a separator 11. From there, portions of the tobacco are separated in a plurality of separators 11–14 as will be described.

Figure 3:
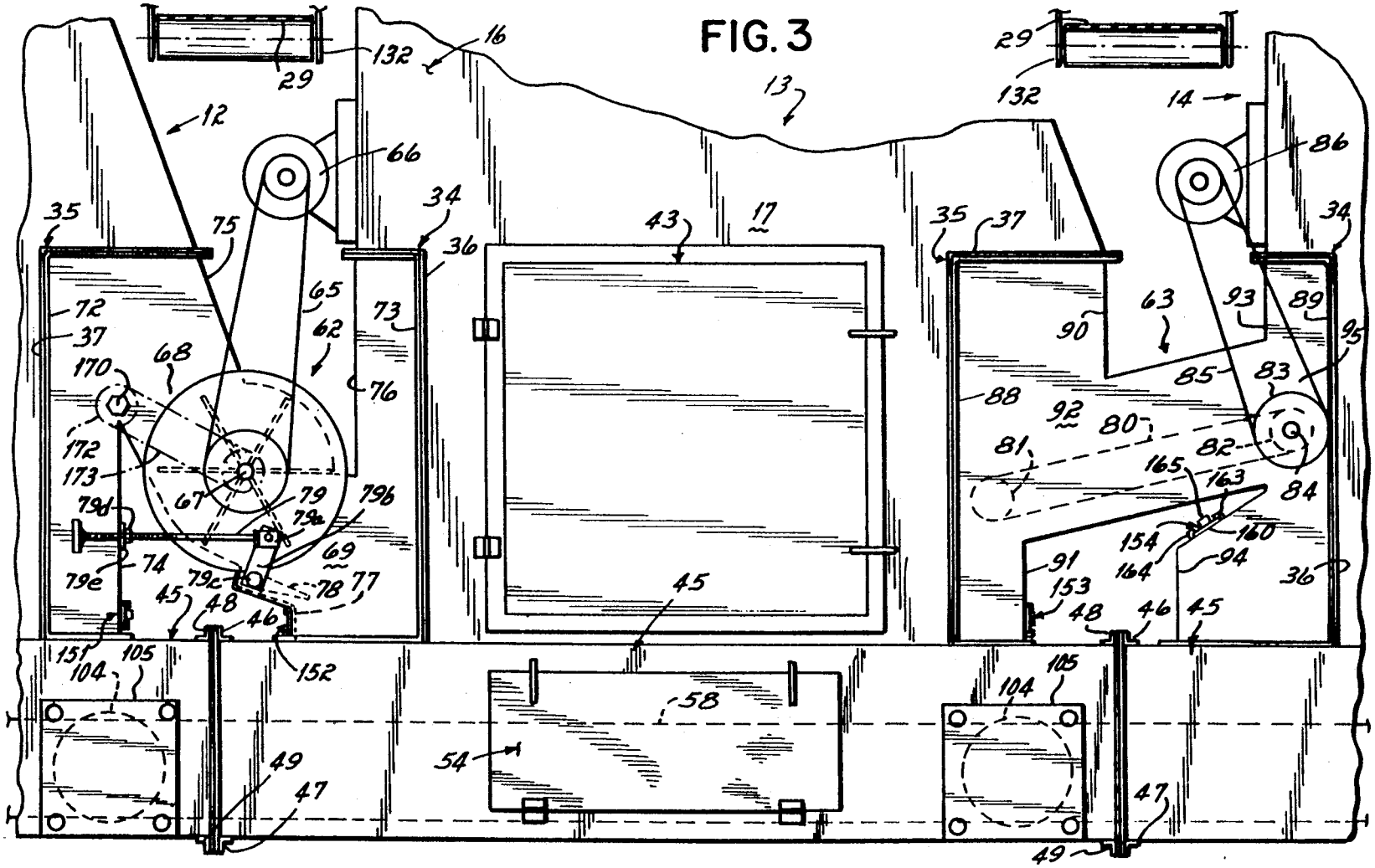
FIG. 3 is a more detailed elevational view of portions of one modular classifier showing its interconnection to adjacent classifiers and respective infeed units for the classifiers.
Figure 4:
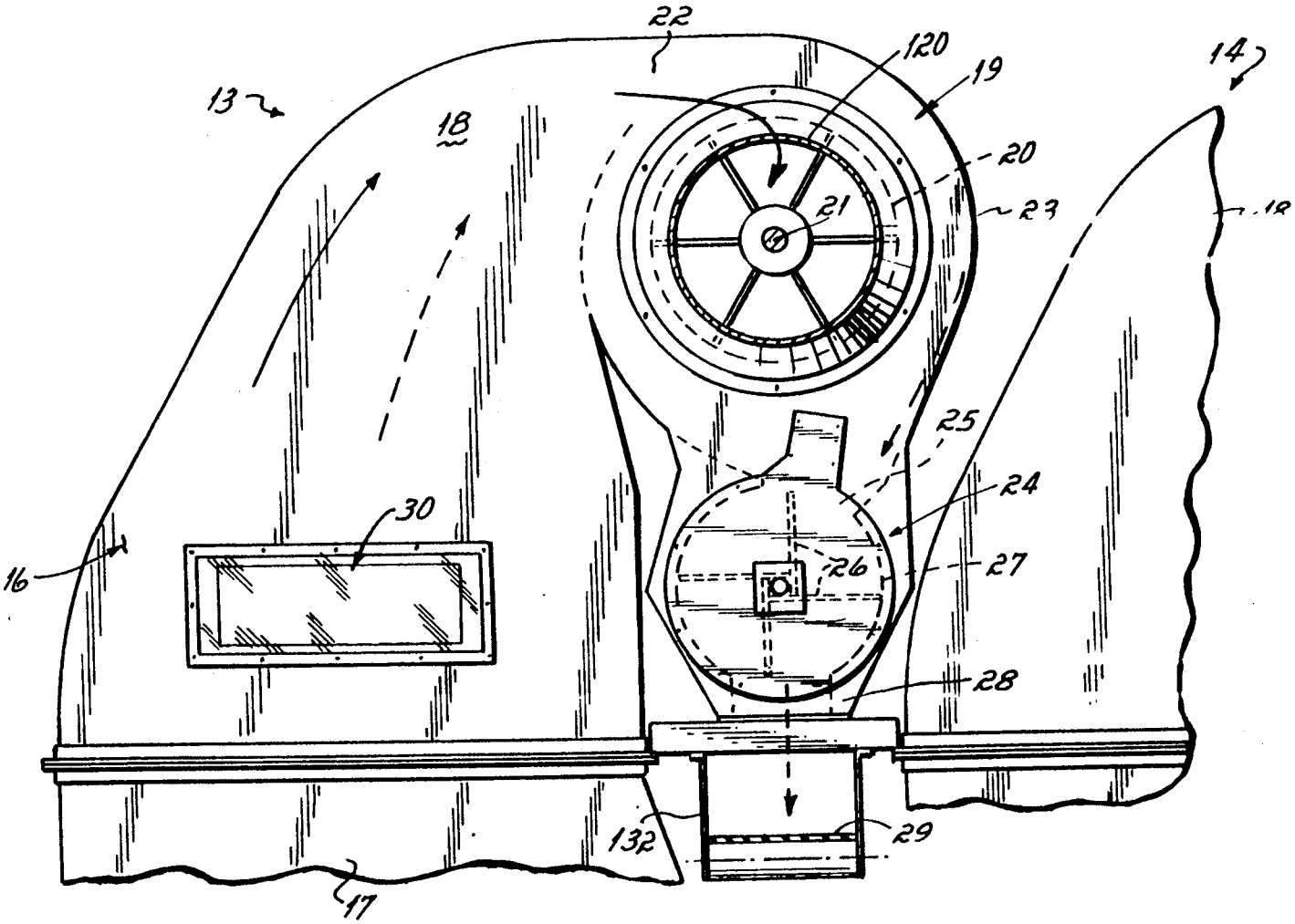
FIG. 4 is a diagrammatic view showing the upper hood of the light fraction removal chamber and the air screener of the modular classifier, of FIG. 3.

An understanding of the structure of each of the modular separators is perhaps best had from a consideration of FIGS. 3 and 4 together. It will be appreciated that FIG. 3 shows intermediate portions of at least one separator 13 while FIG. 4 shows upper portions thereof.

Separator 13 is similar to all of the other separators as will be appreciated. It includes a sheet metal housing 16 defining a separation or classification chamber 17. Chamber 17 has an upper tapering hood 18 defining a light fraction removal chamber and feeding into a rotary screen air separator 19. Rotary screen air separator 19 includes a rotating screen 20 disposed for rotation about an axis 21. As tobacco moves through the inlet port 22 and toward the screen 20, it generally engages a back wall 23 where it falls and drops toward air lock 24.

Air lock 24 has an inlet 25, and a plurality of rotating blades 26 which wipe and seal against the cylindrical walls 27. As the blades 26 rotate, they move tobacco entering the inlet 25 into a discharge chute 28 where the light fraction tobacco is dropped onto a conveyor belt 29, for example, for transport for further processing.

In FIG. 4, the separator 14 is shown just to the right of the separator 13 for orientation purposes. Also, a port 30 is provided in the hood 18 of each separator and a light of any suitable construction (not shown) is mounted therein so that the internal operation can be viewed through transparent door 43.

Returning now to FIG. 3, it will be appreciated that the separator 13 has an intermediate portion in which is located the classification chamber 17. Separator 13 also has an opening 34 and an opening 35 defined by the respective flanges 36, 37. Openings 34, 35 constitute essentially rectangularly shaped openings in the separator 13. These openings are filled by cooperating infeed means as will be described to further define walls of the chamber 17.

Housing 16 is also provided with an access door 43 which may be clear for viewing, but in any event provides access into the chamber 17 for any necessary maintenance or inspection.

Figure 2:
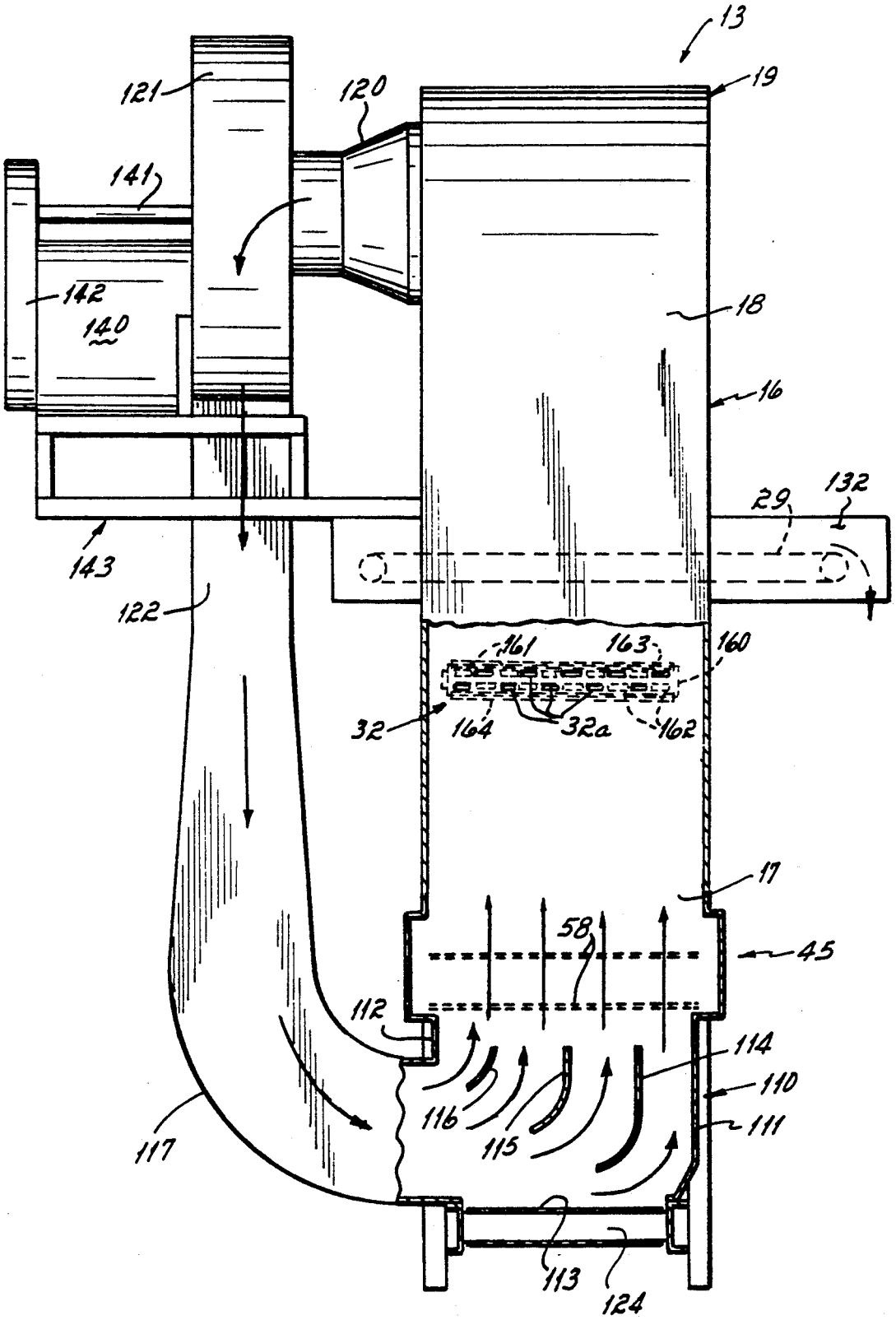
FIG. 2 is a diagrammatic cross-sectional view of one of the modular classifiers of FIG. 1, taken only very generally along lines 2—2 of FIG. 1.

Beneath the classifying chamber 17 each separator, such as separator 13, is provided with a rectangularly shaped, heavies removal chamber 45. Rectangular chamber 45 is of relatively low height as shown in FIG. 3, but wide enough to extend across and beyond the separation chamber 17 (as indicated in FIG. 2). Chamber 45 openly communicates with chamber 17 above, and with an air plenum below, as will be described. Flanges 46, 47 are provided at an upstream end of the heavies removal chamber 45 and flanges 48, 49 are provided at the downstream end of the heavies removal chamber 45 for the purpose of securing this chamber to respective chambers 45 of upstream classifier 12 and the downstream classifier 14. The chambers 45 are provided with access doors such as at 54 for maintenance or inspection.

A heavies collection conveyor 58, comprising a porous apron or belt so that air can pass through it, extends through the various chambers 45 when the classifiers are connected together.

Returning now briefly to FIG. 1, it will be appreciated that each of the modular classifiers is provided with an infeed apparatus such as shown at 60, 61, 62, 63. These infeed apparatus are operable to receive tobacco and to project tobacco across the classification chamber 17 of the respective classifiers so that air moving upwardly through the porous conveyor 58 can carry the lights upwardly into the hoods 18, while other tobacco is projected into the inlets of the next downstream feed means. Thus, for example, some tobacco projected by infeed means 60 is carried upwardly into hood 18 of classifier and some of the tobacco is directed into the inlet 64 of infeed means 61 where that tobacco is then projected across the separation chamber 17 of classifier 12, and so on.

It will be appreciated that the infeed means 60, 61, 62 all comprise multiple vaned rotors. Infeed means 63 comprises a belt conveyor. According to the invention, these various infeed means are interchangeable whether a rotor is used or a belt infeed 63 is used. Alternately, a winnower infeed means having fingers or rakes rotating clockwise as seen in FIG. 1, could be used to engage incoming tobacco and project it across chambers 17. All these respective infeed means are so constructed that they can be interchanged one for the other as is desirable.

Returning now to FIG. 3, The respective infeed means 62, 63 for separator 13 and for separator 14 will be described. Infeed means 62, comprising a variable speed rotor-infeed is operably interconnected between separators 12 and 13. This infeed means comprises a multiple vaned rotor driven by a belt or chain 65 which is in turn driven by an electric motor 66 attached to the housing 16 of the classifier 13. Infeed means 62 comprises a sheet metal housing supporting the rotor axis 67 and defining an inlet 68 and outlet 69. Tobacco from separator 12 is projected into inlet 68 and counterclockwise rotation of the rotor then projects tobacco through the outlet 69 into the classification chamber 17 of separator 13.

The infeed means is further provided with external flanges 72, 73 for interconnection with the flanges 37, 36, respectively, of the two adjacent separators 12 and 13. The infeed means 62 also comprises a plurality of sheet metal walls, such as at 74 and 75, for example. These walls actually define, when the infeed means is in place with respect to separator 12, walls of the classification chamber 17 thereof. Thus, the inlet 68 is defined in part by the top edge of the wall 74 and the wall 75, for example. Walls 76 and 77 on the outlet side define the outlet 69 which also comprises the inlet to the classification chamber of the separator 13, located proximate opening 34.

Moreover, it will be appreciated that an adjustable trajectory vane 78 (FIG. can be used with each rotor infeed to adjust the tobacco trajectory. Vane 78 is controlled by a push-pull apparatus including push-pull rod 79, fitting 79*a* attached to lever 79*b*, and pivot axle 79*c* rotatably mounted and attached to vane 78. Rod 79 can move rearwardly, until rod nut 79*d* contacts flange 79*e* to raise vane 78. Rod 79 is pushed is a reciprocal direction to lower vane 78.

Each of the rotor infeeds is provided with a rotating hexagonal bar 170, extending across the housing above the reverse bend 173 therein, mounted in bearings (not shown) and driven by a pulley 172 slaved to the rotor to rotate the bar 170. This rotation keeps any tobacco falling onto the bar in motion, urging it back into the separation chamber and preventing it from collecting and building up at this reverse bend or housing edge as it otherwise might do without the bar.

Turning now to the infeed means 63, it will be appreciated that no rotor is utilized. Instead, a belt 80 is secured about pulleys 81, 82. Drive pulley 83 is secured to the axis 84 of pulley 82 and is connected via a belt or chain 85 to an electric motor 86 which is attached to the wall of the separator 14 for driving the belt 80.

It will be appreciated that infeed means 63 is comprised of a housing provided with flanges 88 and 89 for interconnection to respective flanges 37 of separator 13 and flange 36 of separator 14. Infeed means 63 is defined by a sheet metal housing having a number of walls such as wall 90 and lower wall 91 defining therebetween an inlet 92 to the infeed means 63. Inlet 92 thus constitutes an outlet for tobacco projected across the chamber 17 of separator 13 by the infeed means 62 and tobacco falling on the inclined, adjustable speed belt conveyor 80 is transported at a desirable speed and inclination where it is projected across chamber 17 of separator 14. While not shown, it will be appreciated that the inclination of conveyor 80 can be constructed so it can be adjusted if desired. Upper and lower sheet metal walls 93, 94 of the inlet means 63 form in part walls of the separator 14 within opening 34 and define therebetween an inlet 95 for separator 14.

It will thus be appreciated that while the infeeds 62 and 63 comprise respectively a rotor or a belt, the two infeed means 62, 63 are interchangeable and their outer housing and flanges match up with their respective openings in any of the classifiers. Accordingly, it will be further appreciated that should any maintenance be necessary with respect to an infeed means, the infeed means can be easily removed from the system and a separate or spare infeed means immediately inserted.

With reference to FIG. 3, it will be appreciated that the various classifiers 11, 12, 13, 14 are interconnected together via the respective infeed means disposed operatively between them and, as well, at the ends of the heavies removal chambers 45 as noted above.

Figure 5:
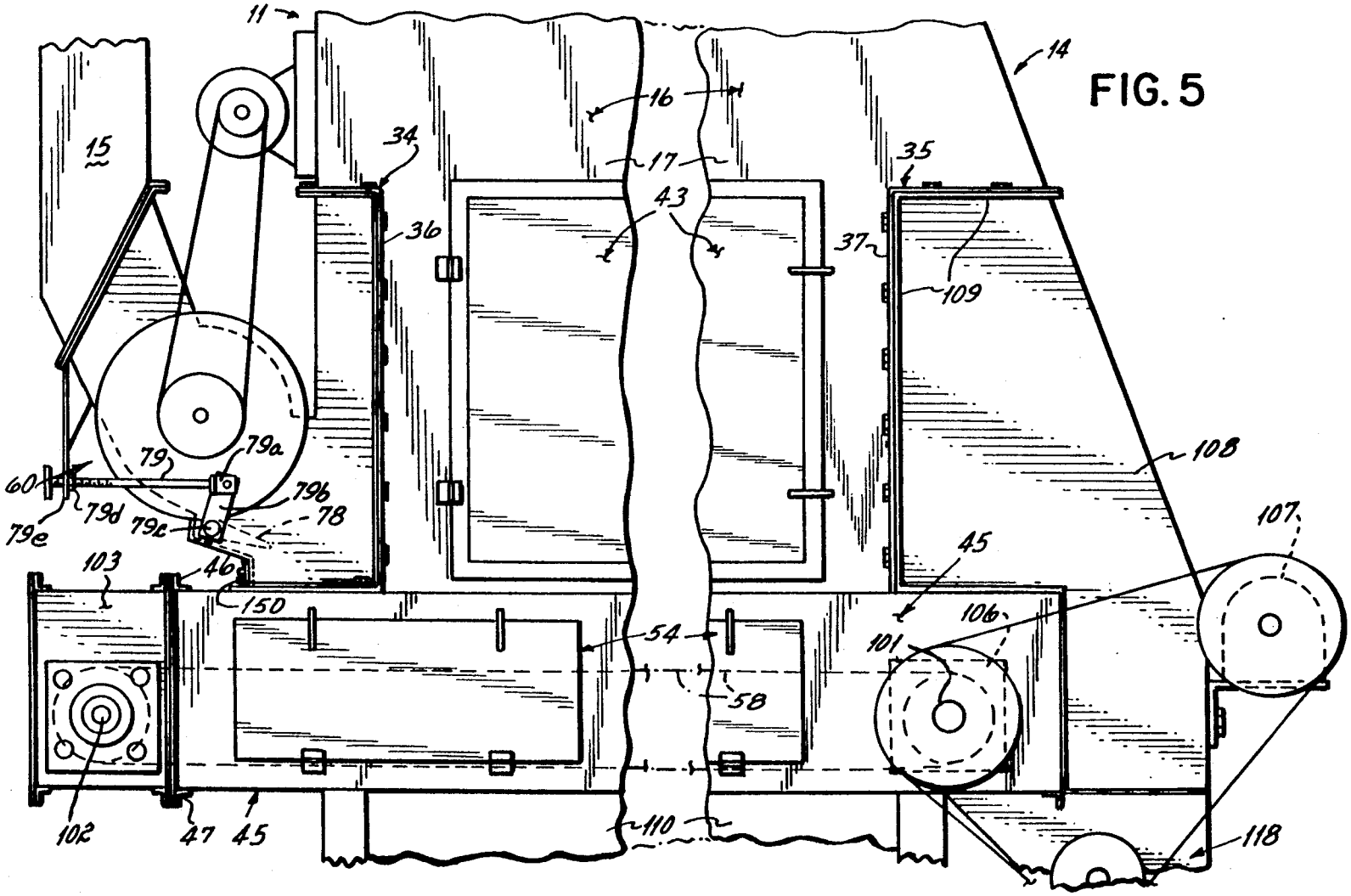
FIG. 5 is a view somewhat similar to FIG. 3 but showing the ends of respective separation chambers at ends of the entire modular classifier apparatus in more detail.

Returning now to a further description of the apparatus as shown in FIGS. 1 and 5, it will be appreciated that the conveyor 58 supported on the headshaft 101 and tailshaft 102 so that the upper run thereof moves to the right as seen in FIGS. 1 and 2. The tailshaft comprises a housing 103 which has flanges as shown in FIG. 5 interconnected to the upstream end of the upstream-most side of the upstream modular classifier 11. Each of the chambers 45 in each module, however, is provided with a circular cut-out, 104 and cover plate 105 (FIG. 3). These accommodate headshaft 101 and headstock 106 driven by any suitable motor 107 through any suitable pulley/sprocket and belt/chain drive. Both the headshaft and tailshaft 101, 102 may be horizontally adjustable to provide adequate take-up. It will be appreciated at the downstream or right hand end of FIG. 5, a nose piece 108 is secured by flanges 109 to the modular separator 14, covering opening 35 therein. Tobacco, other than lifted lights, discharging from chamber 17 of this module is directed toward a multiple vaned air lock 118 disposed beneath nose piece 108 for discharging tobacco onto a conveyor 127 as will be described. A common drive from motor 107 might be used to drive both the headstock 106 and airlock 118, as desired.

Of course, while four classifiers are shown in FIG. 1, it will be appreciated that the conveyor 58 can be extended through any number of classifiers by means of the headshaft and tailshaft 101 and 102 interconnecting on the ends of the various heavy removal chambers at the upstream and downstream ends of the apparatus. The head and tail shafts support end pulleys to support the conveyor. Of course, it may be necessary or desirable to support the porous conveyor 58 with slides, strips, plates, rollers, or other mechanisms through the system as desired.

As perhaps best seen in FIG. 2, it will also be appreciated that each module has a lower air plenum 110 defined in part by walls 111 and 112 from the sides and by a lower self-cleaning floor or discharge conveyor 113. Vanes 114, 115, and 116 are located in the air plenum as shown in FIG. 2 for directing air entering from duct 117 upwardly through the porous conveyor 58 into the classification chambers 17 of the respective modules. The bottoms of the vanes do not contact conveyor 113, and any dust or direct retained can fall onto conveyor 113.

It should be appreciated at this point that each module comprises or defines a closed-loop air system which is perhaps best seen in FIGS. 1, 2, and 4. In FIG. 4, for example, it will be appreciated that the internal side of rotating cylindrical screen 20 communicates with a duct 120 interconnected to the inlet of a blower 121. Blower 121, which can be a squirrel cage or any other suitable type, has an outlet duct 122 feeding into enlarged duct 117 and into the air plenum 110. Duct 117, at its lower end, can be provided with three internal vanes to spread the air across the duct. The air is directed by the vanes 114–116 in plenum 110 upwardly through the porous belt 58 into the classification chamber 17 where it engages or impinges on the projected stream of tobacco and lifts a light tobacco, such as lamina, through inlet 22 into the air separator 19. Rotating screen 20 serves to screen tobacco from the air stream. The air moves through the screen 20 into the duct 120 recirculating to blower 121, all in a closed loop fashion.

As seen in FIG. 2, each of the modules is provided at location 32 with a plurality of elongated slots 32*a* extending substantially across the width of chamber 17, for adjustably admitting make-up air. It will be appreciated that the air flow is shown by the heavy lined arrows in the FIGS. while the tobacco flow is shown with dash line arrows.

While make up air may be admitted in slots 32*a*, make up air is also preferably provided at locations identified at 150 (FIG. 5) and 151, 152, 153 and 154 (FIG. 3) in the various infeed means shown herein. Thus the rotor infeeds have make-up air inlets such as 151, 152 and the belt infeeds have make-up air inlets 153, 154. Each air make-up is essentially of the same construction, including a plurality of staggered slots in the housing wall and a slide gate to partially open, fully open or close the slots. For example, staggered slots 32*a* are shown in FIG. 2 at make-up air location 32. A slide plate 160 (at each air inlet location) has a pattern of staggered upper and lower slots 161, 162 corresponding to the staggered slot pattern 32*a*in the wall of the separator. Lips 163, 164 overlap plate 160 on its respective upper and lower margins. Tab 165 can be manually grasped to slide the plate 160 so its slots align with slots 32*a*, at least partially if not fully, to open the make-up air location, or to cover the slots 32*a*to cut off all make-up air.

As shown diagrammatically in FIG. 2, a motor 140 is arranged to drive a shaft 141 through a belt and pulley drive 142. Shaft 141 is connected to drive the blower 121 and rotating screen 20. Motor 140 and blower 121 are mounted on any suitable frame or support shown diagrammatically at 143.

Referring to FIG. 2, it will be appreciated that the self cleaning conveyor 113 is reversible and is carried by a plurality of rollers 124 or any other suitable means. Any suitable means, such as a reversible motor (not shown) can be used to drive conveyor 113. Conveyor 113 preferably includes sliding or wiper edges and forms a lower floor of the air plenum chamber 110. Any material which either drops off the conveyor 58, or which falls out of suspension in the air stream moving through ducts 122, 117 and air plenum 110 fall onto the conveyor 113 and can be removed in one of two ways.

Returning now momentarily to FIG. 1 it will be appreciated that the conveyor 113 has an upper run and a lower run. When the upper run is moved to the right as viewed in FIG. 1, it discharges any material thereon onto a conveyor 127 which carries and deposits material thereon into an inlet 128 for conveyance through a pneumatic duct, for example, 129 to a downstream thresher 130. It will also be appreciated that the porous conveyor 58 carrying stem and other heavies moves to the right as viewed in FIG. 1 and discharges through an appropriate multiple-vaned air lock 118 also onto the conveyor 127. Thus, any affluent foreign matter dust, etc. falling onto or collected on conveyor 113 is added back into the tobacco product for further treatment.

On the other hand, if the upper run of conveyor 113 is run in the opposite direction, that is to the left as viewed in FIG. 1, any material thereon such as dust, tobacco particles falling from conveyor 58, etc. is discharged onto a second conveyor 135, or into any suitable chute or container for disposal or other treatment. Accordingly, it is not necessary to shut down the respective classifiers every day for cleaning. Instead, they are rendered self-cleaning by the conveyor 113 which substantially reduces down time for cleaning.

Accordingly, the operation of the invention will be appreciated as follows. Tobacco from the thresher is introduced to inlet 15 of the infeed means 60. The multiple vane rotor associated with that infeed means moves in a counterclockwise direction as viewed in FIG. 1 to project a mixed stream of tobacco including the light and heavy components across the classification chamber 17 of the first modular classifier 11. Air generated by blower 121 moves through ducts 122, 117 and down into air plenum 110 where the air is directed upwardly through the porous belt 58 to impinge on the projected tobacco stream. This lifts light components of the tobacco upwardly into the hood 18 in the classifier 11 for removal in separator 19 thereof and delivery onto collection conveyor 29 from where these lights are taken for further treatment. The middle portion of the tobacco stream, however, which is projected fully across the chamber 17 is projected into the inlet 64 of the second infeed means 61. That infeed means is also a multiple vane rotor, in this configuration, which rotates in a counter-clockwise direction as viewed in FIG. 1 to project the stream of tobacco across the chamber 17 of separator 12.

Returning momentarily to separator 11, however, it will be appreciated that further or heavier components of tobacco components fall out of the stream and engage the wall, such as wall 74, of infeed means 61, also comprising a back wall of the separation chamber. These tobacco particles fall onto a porous conveyor 58 for conveyance to the discharge air lock 118. Dashed arrows show various components of tobacco in their general travel across chamber 17. It should be appreciated that some turbulence may be present in chamber 17 and the dashed arrows are only diagrammatic.

Returning now to separator 12, the remaining tobacco stream is projected across that chamber 17. Air from blower 121 associated with separator 12 enters plenum 110 thereof and is projected upwardly from conveyor 58 to impinge on the tobacco stream and again lift lighter components away from that stream, while permitting heavy components to fall on belt 58 and while helping to carry intermediate portions of the tobacco into the inlet 68 of the next downstream infeed means 62.

The operation of the separator 13 receiving this tobacco stream is similar to that described above for separators 11 and 12. However, the intermediate tobacco components passing across chamber 17 of separator 13 do not engage inlet 68 of a rotor-type infeed means, but rather are projected into the inlet 92 of the belt-type infeed means 63, as shown. The inclined belt runs at a speed to take tobacco falling thereon and project it across classification chamber 17 of separator 14.

In the meantime, of course, the heavies from all of the chambers 17 fall onto the common porous belt 58 extending through the heavy removal chambers of each of the modules and are discharged through the air lock 118. Any material falling off conveyor 58, or dust coming out of the closed loop air streams in each of the modular separators, is collected on belt 113 where it is rejoined with the heavies on conveyor 127. Or conveyor 113 is operated in a reverse direction to discharge onto conveyor 135 on to some other means for collection and disposal.

It will be appreciated from a review of FIG. 1 that the infeed means 60–63 are preferably disposed at the same elevation and it is not necessary to piggyback or raise an upstream classifier above the next downstream classifier in order to provide a tobacco stream discharging across the classification chambers directly into the infeed of the next downstream classifier.

It will also be appreciated that each of the modules and each of the infeed means are interchangeable one with the other and a varying numbers of modules or infeed means can be used.

It will also be appreciated that the conveyors, such as conveyors 58 and conveyors 29, for example, are provided with side wipers, channelized belts or the like so that material is not disposed to fall from the conveyors. Moreover, it will be appreciated that conveyor 29 is carried within its own housing 132 so that the lights received thereon can be discharged from the conveyor 29 into suitable Collection means for further process.

Accordingly, it will be appreciated that the invention provides a huge energy savings over prior separators where separate conveyors were required between each of the separators. This results in a significant saving of floor space and energy. Moreover, the self cleaning aspect provided by the conveyor 113 reduces downtime for cleaning and maintenance and provides for further processing as desired. Such a modular classifier provides as compared to prior systems of classifiers interconnected together by means of intervening conveying mechanisms, less capital cost, lower installation cost, and less installation time. It also provides lower maintenance cost.

Moreover, it will be appreciated that any of the infeed means can be interchanged depending on the particular result desired and that the system produces a smooth flow of tobacco therethrough without any undue surging.

It will further be appreciated that the recycled air from the respective blowers is preferably introduced in only one side of the air plenum. Air could be introduced into both sides thereof, with some change in the vanes, for particularly wide units.

Finally, it will also be appreciated that any number of varying parameters of air flow and volume can be used to provide the desirable results. The blower speeds and the rotor speeds can be adjusted to adjust the nature of the projected tobacco stream and the air flowing upwardly therethrough. Air velocities in the neighborhood of 500 ft. per min. or slightly above have been found to be suitable. Moreover, it will be appreciated that adjustable vanes 78 can be utilized beneath each of the infeed rotors for controlling the inclination of the projected tobacco stream, while the inclination of the belt infeed means 63 could also be adjusted to the same end.

These and other advantages and modifications will become readily apparent from the foregoing description without departing from the scope of the invention, and the applicant intends to be bound only by the claims appended hereto.

I claim:

1. Classifying apparatus for separating heavy and light material fractions conveyed in a mixed stream of material, said apparatus comprising:

a plurality of single pass, vertical lift, serially oriented classifier modules, each comprising an upper classifying chamber, a heavy fraction removal chamber, a lower air inlet plenum, an inlet opening on one side of said classifying chamber, an outlet opening on another side of said classifying chamber, and a light fraction outlet at an upper portion of said classifying chamber;

each said module further including an infeed means operably disposed proximate each respective classifying chamber for receiving mixed material for classification and for projecting a stream of said mixed material across a respective classifying chamber in a single pass for upward separation of lighter fractions from heavier fractions, one of said infeed means being operatively connected between an opening of an upstream module and an opening of a downstream module for receiving mixed material from an upstream module and for projecting a stream of mixed material across the chamber of a downstream module, said heavy fraction removal chamber of each module being operatively connected to the heavy fraction removal chamber of adjacent modules, a heavy fraction removal conveyor extending through said connected heavy fraction removal chambers, and means in said lower air inlet plenum for directing a flow of mixture separation air upwardly through said classifying chamber of each module, said modules each being interchangeable with and operably connectable to other like modules.

2. Classifying apparatus as in claim 1 wherein each module further includes a light fraction removal chamber operatively disposed over said classifying chamber, means for screening said light fraction from a light fraction conveying air stream, and means for collecting said light fraction outside said air stream.

3. Classifying apparatus as in claim 2 wherein each module further includes a blower for receiving air from said receiving means and for blowing separation air into said lower air inlet plenum and upwardly through said classifying chamber, said separation air moving in a closed loop from said classifying chamber through said screening means and through said flow directing means back into said classifying chamber.

4. Classifying apparatus as in claim 1 wherein said heavy fraction removal conveyor is a porous apron and further including:

an apron headshaft;

an apron tailshaft;

said head and tail shafts being oriented at respective downstream and upstream sides of downstream and upstream modules and operatively mounting said apron for extension through said intermediate heavy fraction removal chambers of each module for receiving and removing heavy fractions of said mixture falling out from each classifying chamber.

5. Classifying apparatus as in claim 4 wherein said headshaft is mounted within the heavy fraction removal chamber of the downstream module and wherein said tailshaft is mounted proximate an upstream end of the heavy fraction removal chamber of said upstream module.

6. Classifying apparatus as in claim further including a second conveyor extending through lower portions of said lower air inlet plenums.

7. Classifying apparatus as in claim 6 wherein said second conveyor is disposed beneath said heavy fraction removal conveyor for receiving effluent and for removing such effluent from each of said modules.

8. Classifying apparatus as in claim 7 wherein said air flow directing means include vanes for directing air in said lower air inlet plenum upwardly toward said classifying chamber, said vanes having upstream ends, with respect to said air flow, disposed above said second conveyor.

9. Classifying apparatus as in claim 6 wherein said second conveyor is reversible for returning material thereon to heavier material fractions when operated in one direction and for discharging material thereon for separate collection, processing or waste discharge when operated in another direction.

10. Classifying apparatus as in claim 1 wherein said infeed means comprises mixed material receiving and projecting means for receiving mixed material and projecting it in a stream across a classifying chamber.

11. Classifying apparatus as in claim 10 wherein said mixed material receiving and projecting means comprises a belt conveyor having a mixed material receiving ends and a mixed material projecting ends.

12. Classifying apparatus as in either of claims 1 or 10 wherein said infeed means are interchangeable from any of said modules to another.

13. Apparatus for separating light tobacco fractions from heavier tobacco fractions comprising:

a series of single pass, vertical lift separators serially and operably connected together, and each having a classifying chamber, infeed means disposed on an inlet side of each separator for projecting a stream of mixed tobacco fractions across said classifying chamber of each separator, means for directing a flow of separation air vertically upwardly in each classifying chamber to lift light tobacco fractions from said stream, the infeed means of a downstream separator oriented for receiving a portion of said projected stream directly from the infeed means of an upstream separator and for projecting said portion across the classifying chamber of said downstream separator, a heavy fraction removal chamber in each separator beneath said classifying chamber, said heavy fraction removal chamber in each separator defining an elongated, common conveyor run extending beneath the classifying chambers of all said separators, a single horizontally disposed conveyor in said heavy fraction removal chambers for receiving heavy fractions from each of said classifying chambers, and each of said separators being serially and operationally connected together along the same horizontal disposition.

14. Apparatus as in claim 13 including another conveyor disposed beneath said single conveyor, and extending through said air inlet plenums for removing carryover from said single conveyor and residues from said separation air flow.

15. Apparatus as in claim 14 wherein said other conveyor is reversible.

16. Apparatus as in claim 13 including a deflector vane disposed proximate an infeed means of a separator for adjusting the trajectory of projected tobacco fractions therefrom and with respect to an inlet of the succeeding downstream infeed means of an adjacent module.

17. Apparatus as in claim 13 wherein said separators are interchangeable, one for the other.

18. Apparatus as in claim 13 wherein said infeed means of each separator are disposed in a common horizontal plane.

19. Apparatus as in claim 13 wherein said infeed means are interchangeable.

20. Apparatus for separating tobacco lamina from tobacco stem, said apparatus comprising:

a plurality of serially connected, single-pass vertical lift separators, each having a classifying chamber and each defining a closed loop path for flow therein of separation air, said path and flow extending through said classifying chamber, an infeed means having an inlet and being operatively associated with each separator for projecting a stream of mixed lamina and stem across the proximate classifying chamber such that lighter lamina can be vertically lifted and separated from said stream and heavier tobacco stem can fall out of said stream, and such that the remainder of said stream is directed into the inlet of a downstream infeed means, each separator including a heavier removal chamber therein to into which heavier tobacco stem parts descend, and a single stem removal conveyor extending through each separator's heavier stem removal chamber beneath said classifying chamber for receiving tobacco stem therefrom, each of said separators in the apparatus being interchangeable with each other.

21. Apparatus as in claim 20 wherein each separator includes an inlet air plenum beneath said conveyor and said apparatus further including a second conveyor means beneath said air plenums, extending through said separators and beneath said stem removal conveyor for receiving and removing from said separators tobacco parts and residue falling thereon.

22. Apparatus as in claim 21 wherein said second conveyor means is reversible.

23. A module for use in a classifying apparatus with other like modules for classifying lighter fractions from heavier fractions in a mixture thereof, said module comprising a vertical lift, single pass separator having:

a classifying chamber, a heavy fraction removal chamber disposed beneath said classifying chamber for receiving a common, horizontally disposed conveyor, and having upstream and downstream ends, an air inlet plenum beneath said heavy fraction removal chamber, an inlet opening in said classifying chamber, an outlet opening in said classifying chamber, and means on the upstream and downstream ends of said heavy fraction removal chamber for connection to ends of respective heavy fraction removal chambers of adjacent separators, such that said conveyor can extend through said chambers.

24. A module as in claim 23 further including a light fraction chamber disposed over said classifying chamber, and means for generating and defining a closed separation air loop for blowing separation air upwardly into said classifying chamber from said air inlet plenum, into said light fraction removal chamber, and returning to said air inlet plenum.

25. A module as in claim 24 further including an infeed means for projecting a stream of mixed lighter and heavier fractions across said classifying chamber.

26. A module as in claim 25 wherein said infeed means includes an inlet for receiving a portion of said projected stream from within an upstream module when two modules are operably connected together.

27. Apparatus for separating tobacco lamina threshed from tobacco stem including:

a plurality of serially interconnected single-pass vertical lift classifiers, each having a classifying chamber, infeed means for receiving mixed tobacco lamina and stem and for projecting a stream of such mix across said classifying chamber, and means for directing a flow of separation air upwardly through said stream to lift lighter lamina from heavier stem, a first common conveyor extending horizontally beneath the classifying chambers of the plurality of classifiers for receiving tobacco stem, and said infeed means having an inlet disposed to receive a portion of said projected stream directly from an upstream classifier which portion is neither lifted from said projected stream nor dropped onto said conveyor, said classifiers being interchangeable, one with another, and being oriented along the same horizontal disposition.

28. Apparatus as in claim 27 wherein each classifier further includes an air plenum chamber disposed beneath said classifying chamber and said first conveyor, and said apparatus further including a second common conveyor extending beneath said respective air plenum chambers for collecting fallout and residue from each classifier.

29. Apparatus as in claim 27 wherein said classifiers each include a first common conveyor chamber beneath said classifying chamber and through which said first common conveyor extends, and wherein said classifiers are operationally interconnected together through attachment thereto of intervening infeed means, and through attachment of said common conveyor chambers.

30. Apparatus as in either of claims 27 or 29 wherein said infeed means are interchangeable.

31. A method of separating heavy and light material fractions conveyed in a mixed stream of both fractions of material, said method comprising the steps of:

projecting a stream of mixed material progressively across separation chambers of a plurality of modular separators;

blowing air upwardly in each chamber to lift away lighter fractions of material;

receiving heavier fall-out fractions of material in a lower portion of each chamber on a common conveyor and conveying such heavier portion horizontally into successive downstream separators;

receiving a mixed stream of material, which has not been lifted away or fallen out, at a downstream side of each said chamber at a vertical disposition substantively horizontally level with the location from which said mixed stream was projected and except for the last downstream separation, projecting said mixed stream across the separation chamber of the next downstream separator for further separation.

32. A method as in claim 31 wherein said method includes receiving material falling below said common conveyor onto a second common conveyor therebeneath and selectively carrying said material to a downstream or upstream location with respect to said plurality of separators for discharge or for intermingling with a mixed stream of material for further separation.

33. A method of separating from a mixed stream of tobacco the lighter fractions of tobacco from the heavier fractions of tobacco in a modular classifier comprising a series of side-by-side operationally interconnected separation chambers, each method including, in each upstream chamber:

projecting said stream across said chamber;

dividing said mixed stream into three components including a lighter fraction component, and a heavy fraction component;

lifting away said lighter fractions from each chamber by blowing said lighter fractions upwardly;

conveying heavier fractions falling out of said stream horizontally into a downstream chamber on a common conveyor; and receiving a mixed stream of fractions neither lifted away nor fallen out from said projected stream in said chamber, and projecting said received stream across a downstream separation chamber.

34. Classifying apparatus for separating heaving and light material fractions conveyed in a mixed stream of material, said apparatus comprising:

a plurality of single pass, vertical lift, serially oriented classifier modules, each comprising an upper classifying chamber, a heavy fraction removal chamber, a lower air inlet plenum, an inlet opening on one side of said classifying chamber, an outlet opening on another side of said classifying chamber, and a light fraction outlet at an upper portion of said classifying chamber;

each said module further including an infeed means operably disposed proximate each respective classifying chamber for receiving mixed material for classification and for projecting a stream of said mixed material across a respective classifying chamber in a single pass for upward separation of lighter fractions from heavier fractions, one of said infeed means being operatively connected between an opening of an upstream module and an opening of a downstream module for receiving mixed material from an upstream module and for projecting a stream of mixed material across the chamber of a downstream module, said heavy fraction removal chamber of each module being operatively connected to the heavy fraction removal chamber of adjacent modules, a horizontally disposed heavy fraction removal conveyor extending through said connected heavy fraction removal chambers, and means in said lower air inlet plenum for directing a flow of mixture separation air substantially vertically upwardly and perpendicularly through said conveyor and through said classifying chamber of each module, said modules each being interchangeable with an operably connectable to other like modules.

* * * * *

UNITED STATES PATENT AND TRADEMARK OFFICE

CERTIFICATE OF CORRECTION

PATENT NO. : 5,205,415

DATED : April 27, 1993

INVENTOR(S) : Guy F. Surtees

It is certified that error appears in the above-indentified patent and that said Letters Patent is hereby corrected as shown below:

On the title page, and column 1, line 2, the title should read --MODULAR MULTIPLE CHAMBER CLASSIFIER--.

Column 3, line 27, "Fig." should be -- Fig. 1 --.

Column 5, line 20, "(Fig." should be -- (Fig. 1) --.

Column 14, line 27, "heaving" should be -- heavy --.

Signed and Sealed this

Twenty-seventh Day of December, 1994

*Attest:*

Bruce Lehman

BRUCE LEHMAN

*Attesting Officer*

*Commissioner of Patents and Trademarks*